US006504122B2

(12) United States Patent
Yu

(10) Patent No.: US 6,504,122 B2
(45) Date of Patent: Jan. 7, 2003

(54) CONTROL DEVICE FOR A PUSH-BUTTON TYPE SWITCH

(76) Inventor: Tsung-Mou Yu, No. 4, Alley 2, Lane 23, Sec. 3, Pa Te Road, PanChiao City, Taipei Hsien (TW)

( * ) Notice: Subject to any disclaimer, the term of this patent is extended or adjusted under 35 U.S.C. 154(b) by 14 days.

(21) Appl. No.: 09/811,089

(22) Filed: Mar. 17, 2001

(65) Prior Publication Data

US 2002/0130026 A1 Sep. 19, 2002

(51) Int. Cl.[7] ..... H01H 3/42
(52) U.S. Cl. ..... 200/524
(58) Field of Search ..... 200/524

(56) References Cited

U.S. PATENT DOCUMENTS 3,187,602 A * 6/1965 Cousins ..... 200/524 X
4,795,860 A * 1/1989 Kamada et al. ..... 200/524 X
4,916,276 A * 4/1990 Sasaki ..... 200/524
5,711,414 A * 1/1998 Nishitani et al. ..... 200/524

* cited by examiner

*Primary Examiner*—Renee Leubke

(57) ABSTRACT

A push-button type switch includes a box with a button movably inserted in the box and a movable member has a U-shaped guide member which has an end engaged with an enclosed recessed area in the button. The movable member can be operationally connected with a bimetal plate or the like to move the movable member when override. The movement of the movable member leads the leg of the U-shaped guide member to move within the inner periphery of the recessed area so as to move the button upward.

6 Claims, 8 Drawing Sheets

CONTROL DEVICE FOR A PUSH-BUTTON TYPE SWITCH

FIELD OF THE INVENTION

The present invention relates to a push-button type switch having a movable member with a guide member extending therefrom and the guide member is movably retained in a polygonal recessed area in the button so that when the movable member is moved, the button is co-moved with the movable member.

BACKGROUND OF THE INVENTION

A conventional switch has a bimetal plate which is deformed when the current overrides so as to separate two contact points to open the circuit. This type of switch is disclosed in the related prior arts. These switches have a fulcrum type button which can be pressed at either end to operate the switch. However, the fulcrum point of the button tends to be worn out after being used for a period of time and the action of the switch becomes slow.

Another push-button type switch is developed wherein the button is moved up and down and has no fulcrum point. The users can easily check the state of the switch by the position of the button. This type of switch does not have a proper mechanism to cooperate with the button to release the override situation. In other words, because the directions of the button are up and down so that the mechanism could be too large and is not suitable to be received in a switch box.

The present invention intends to provide a control device for a push-button type switch and changes a horizontal action into a vertical action to activate the button.

SUMMARY OF THE INVENTION

In accordance with one aspect of the present invention, there is provided a push-button type switch comprising a box having a button movably inserted in an open top of the box. A tubular member extends from an underside of the button and a spring is biased between the tubular member and the box. A recessed area is defined in a surface of the tubular member and defined by a polygonal inner periphery. A movable member has two slots defined therethrough and the two rods are movably received in the two slots. A guide member extends from the movable member and is movably engaged with the recessed area.

The object of the present invention is to provide a push-button type switch that has a movable member with a guide member movably engaged with a polygonal recess in the button so that when the movable member is moved by a bimetal plate, for example, the button is moved upward to open the circuit.

The present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
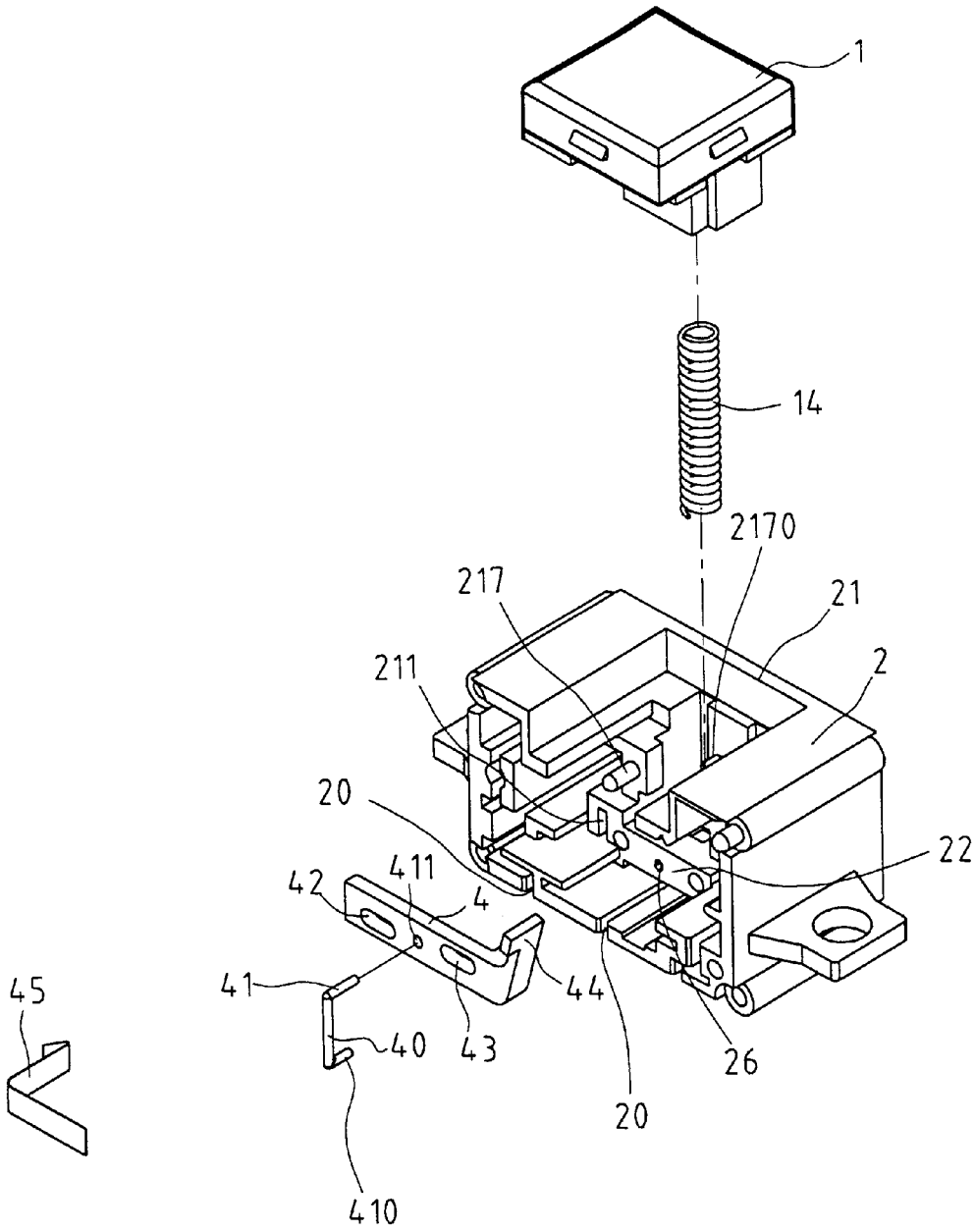
FIG. 1 is an exploded view to show the push-button type switch of the present invention.
Figure 2:
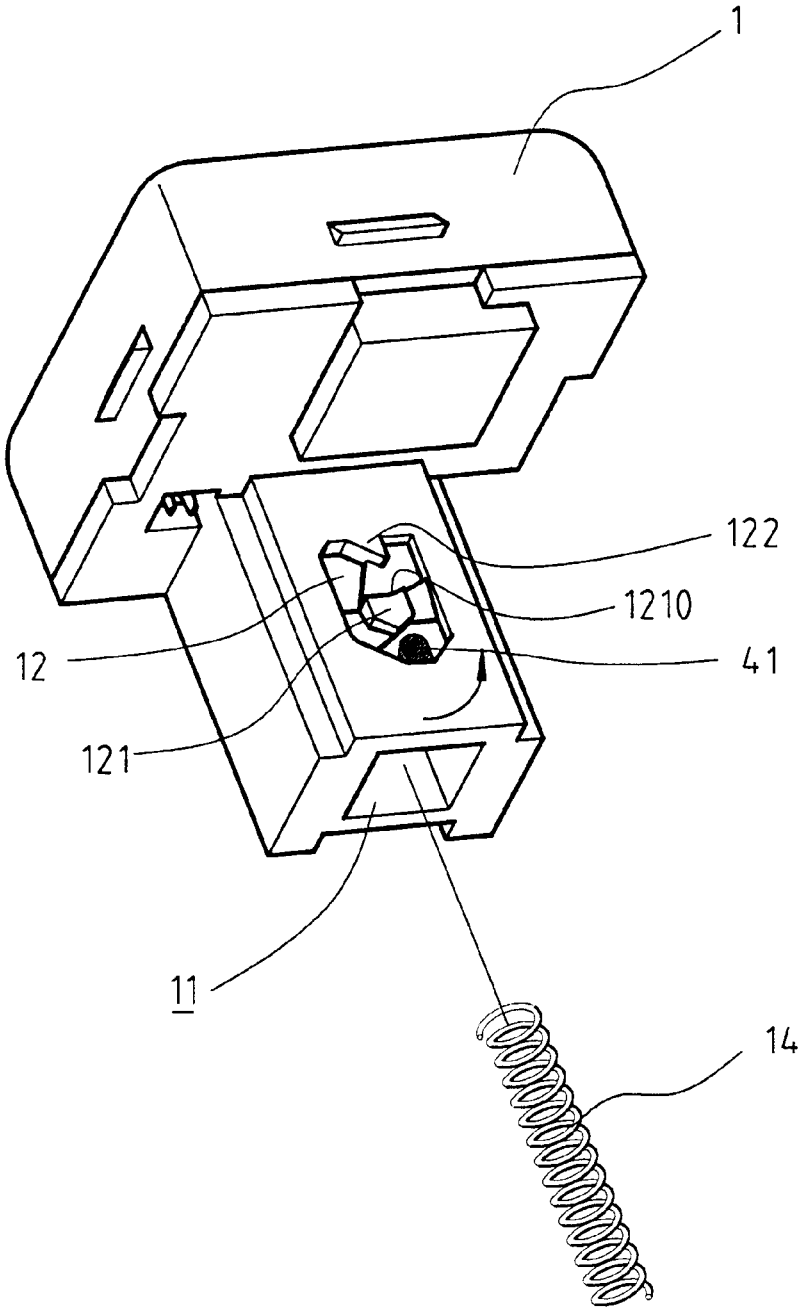
FIG. 2 is an exploded view to show a push button and a spring of the present invention.
Figure 3:
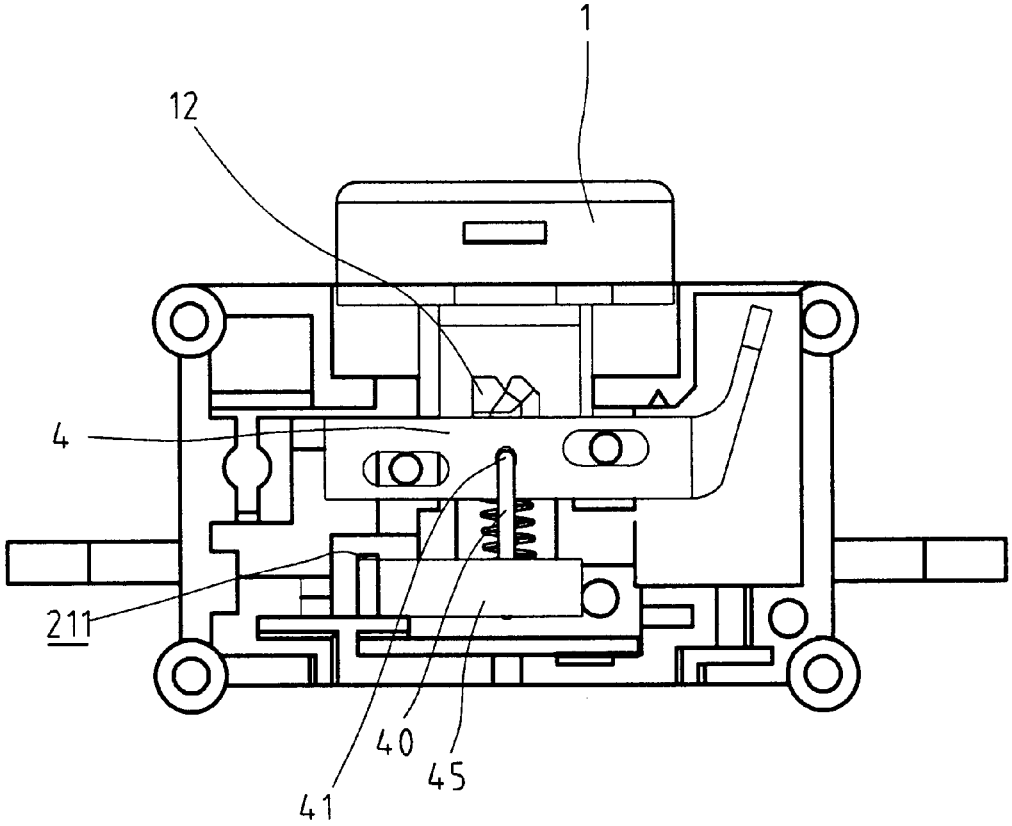
FIG. 3 is an illustrative view to show an open circuit state of the push-button type switch of the present invention.

Referring to FIGS. 1 to 3, the push-button type switch in accordance with the present invention comprises a box 2 having a button 1 movably inserted in an open top 21 of the box 2. A tubular member 11 extends from an underside of the button 1 and a hole is defined in an underside of the tubular member 11 so as to receive one end of a spring 14 therein. The other end of the spring 14 contacts an inner side of the box 1. A recessed area 12 is defined in a surface of the tubular member 11 and the recessed area 12 has a polygonal inner periphery. A central member 121 is located in a center of the recessed area 12 and a dent 1210 is defined in a top of the central member 121. A triangle plate 122 extends from the inner periphery of the recessed area 12 and is located above the dent 1210 of the central member 121. Two slots 20 are defined through an underside of the box 2 so that two terminal plates (not shown) are inserted in the two slots 20. Two rods 217, 2170 respectively extend from the inner side of the box 2. A board 22 extends from the inner side of the box 2 and a hole 26 is defined in a surface of the board 22.

A movable member 4 has two slots 42, 43 defined therethrough and the two rods 217, 2170 are movably received in the two slots 42, 43. A push end 44 extends from an end of the movable member 4. A U-shaped guide member 40 has a leg 41 thereof extending through a hole 411 in the movable member 4 and is movably engaged with the recessed area 12. The other leg 410 of the U-shaped guide member 40 is inserted in the hole 26 in the board 22. An L-shaped spring 45 has one end engaged with a recess 211 defined in an underside of the board 22 and the other end of the L-shaped spring 45 pushes the U-shaped guide member 40 toward the recessed area 12 of the button 1.

Figure 6D:
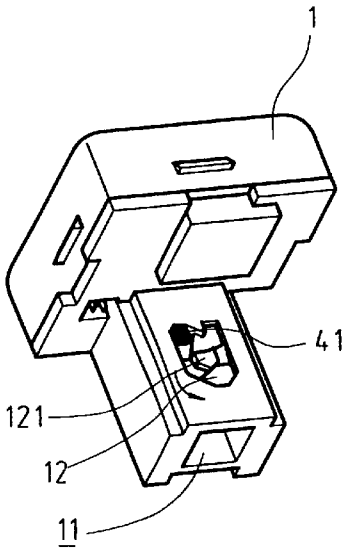
FIG. 6*d* shows the position of the leg of the U-shaped guide member in the recessed area of the push button when the button is pushed to open the circuit.
Figure 6C:
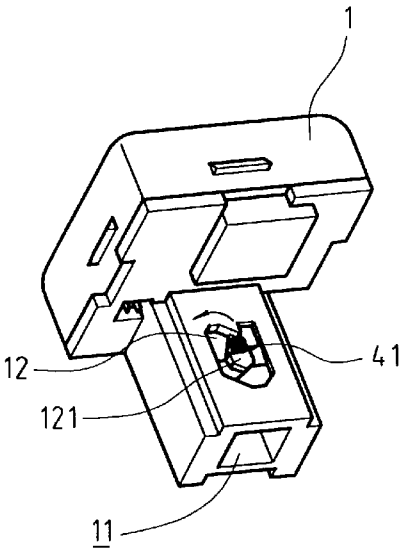
FIG. 6*c* shows the position of the leg of the U-shaped guide member in the recessed area of the push button when the circuit is in a closed position.
Figure 6B:
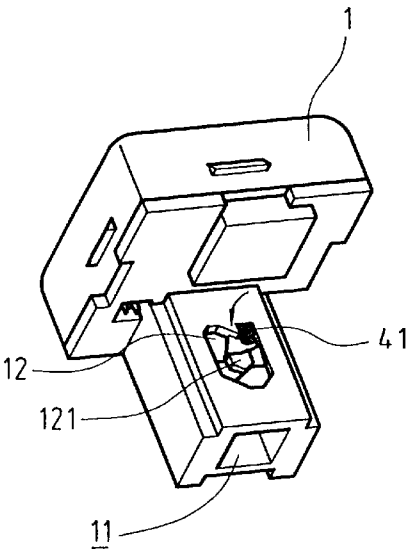
FIG. 6*b* shows the position of the leg of the U-shaped guide member in the recessed area of the push button when the button is pushed to close the circuit.
Figure 6A:
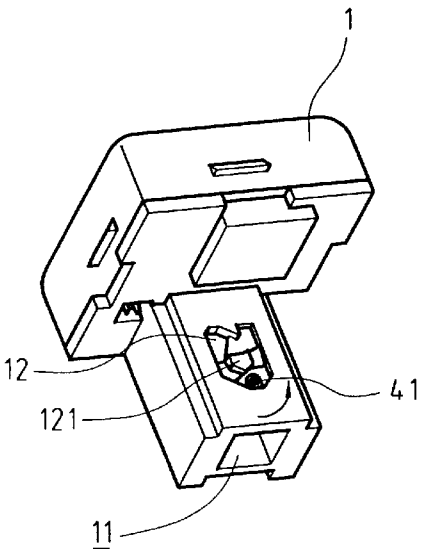
FIG. 6*a* shows the position of a leg of the U-shaped guide member in the recessed area of the push button when the circuit is in an open position.

When the circuit is in an open state, the button 1 is located at the highest position by the spring 14 as shown in FIG. 3 and the leg 41 is located at a lowest position in the recessed area 12 as shown in FIG. 6*a*.

Figure 4:
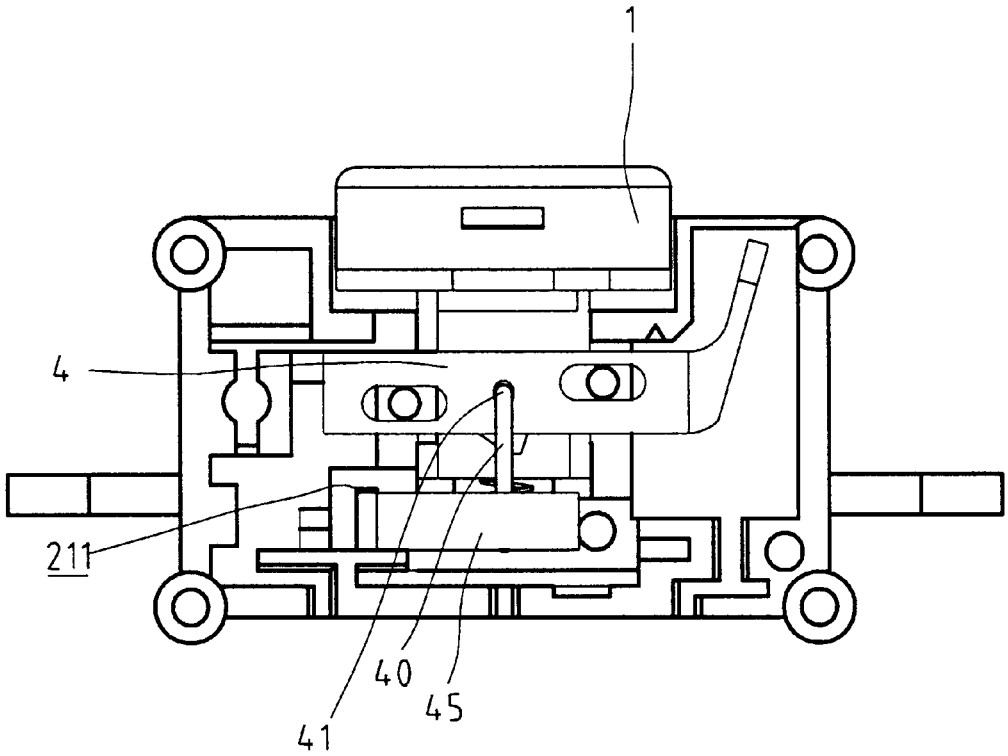
FIG. 4 is an illustrative view to show a close circuit state of the push-button type switch of the present invention by pushing the button.

As shown in FIGS. 4 and 6*b*, when the button 1 is pushed to close the circuit, the leg 41 of the U-shaped guide member 40 is moved counter-clockwise. When the user releases the button 1, the button 1 slightly moves upward and the leg 41 is in the dent 1210 and located between the triangle plate 122 and the central member 121 as shown in FIG. 6*c*. At this position, the leg 41 keeps the button 1 at the position so that it is not pushed upward by the spring 14. When the button 1 is pushed again, the circuit will be opened and the leg 41 is moved as shown in FIG. 6*d*.

Figure 5:
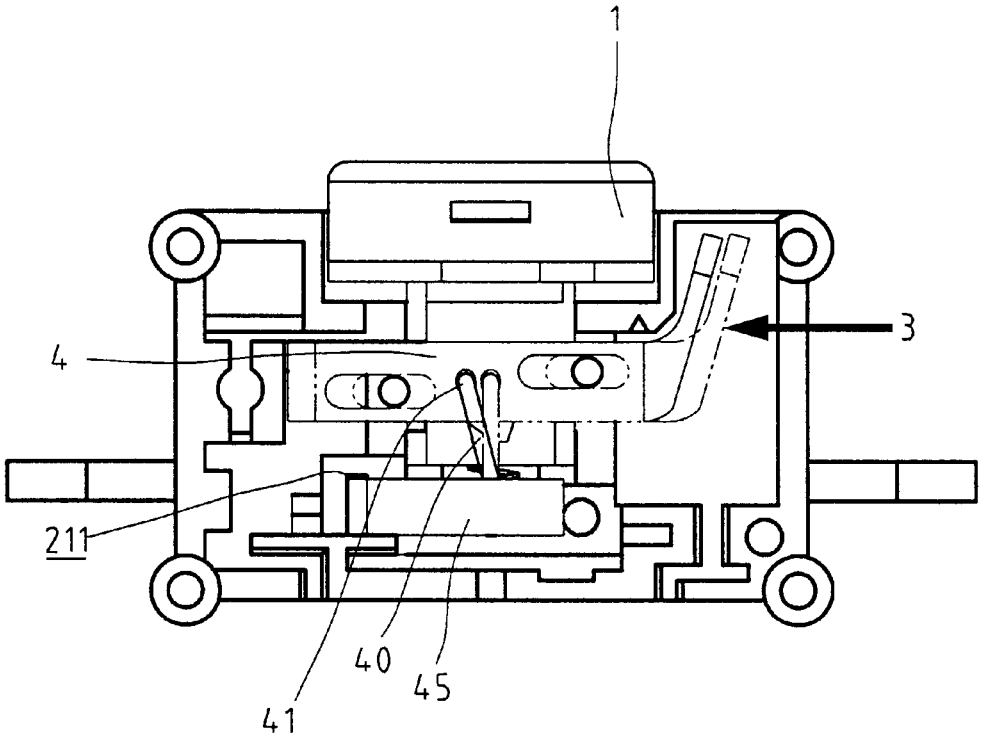
FIG. 5 is an illustrative view to show that the movable member is pushed by force to move left.
Figure 7C:
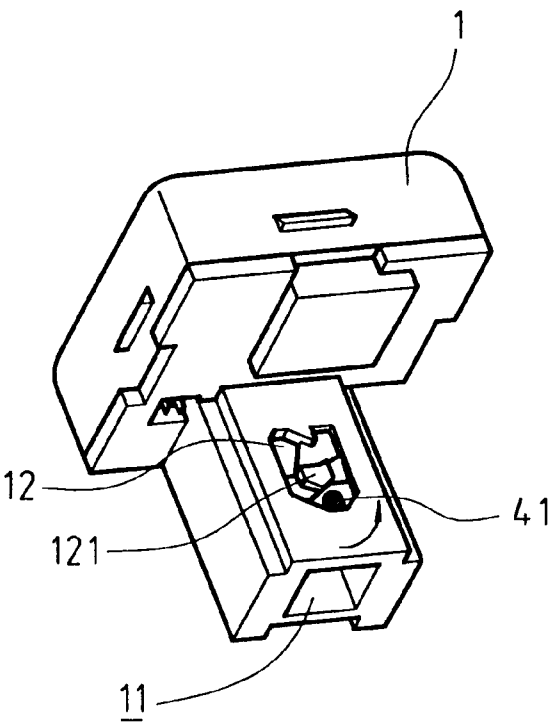
FIG. 7*c* shows that when the movable member is pushed and the circuit is opened, the button jumps up and the leg of the U-shaped guide member is located at the position the same as that shown in FIG. 6*a*.
Figure 7B:
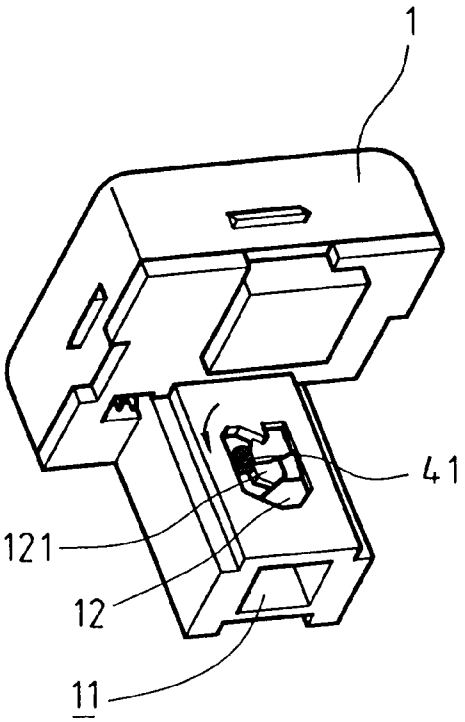
FIG. 7*b* shows that when the movable member is pushed, the leg of the U-shaped member is shifted left.
Figure 7A:
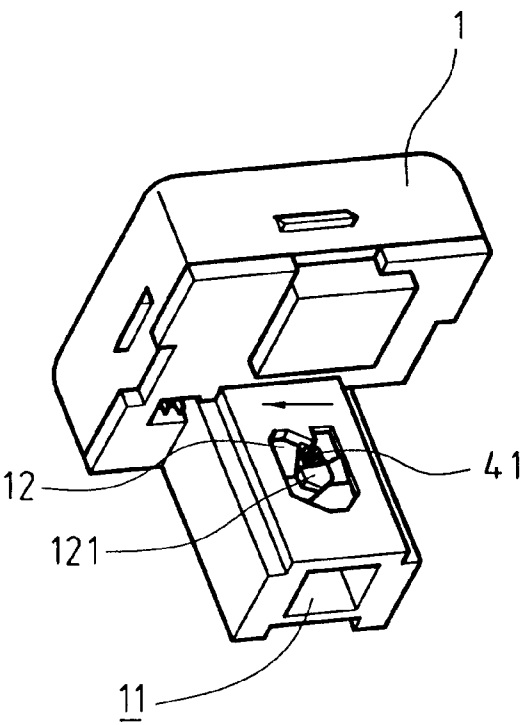
FIG. 7*a* shows that when the movable member is to be pushed, the leg of the U-shaped guide member is located in the close circuit position the same as that shown in FIG. 6*c;*

FIG. 5 shows that force 3 pushes the push end 44 of the movable member 4 when the current overrides. The leg 41 of the U-shaped member 40 is shifted left from the position in FIG. 7*a* to the position in FIG. 7*b*. This movement of the leg 41 in the recessed area 12 makes the button 1 jump up, and the leg 41 of the U-shaped member 40 is then moved to the position as shown in FIG. 7*c*. The force 3 is generated by a bimetal plates for example, which is deformed when the current overrides so as to push the push end 44 toward left. By this way, the size of the switch box 2 can be nude in a limited volume and has a simple structure.

Figure 8:
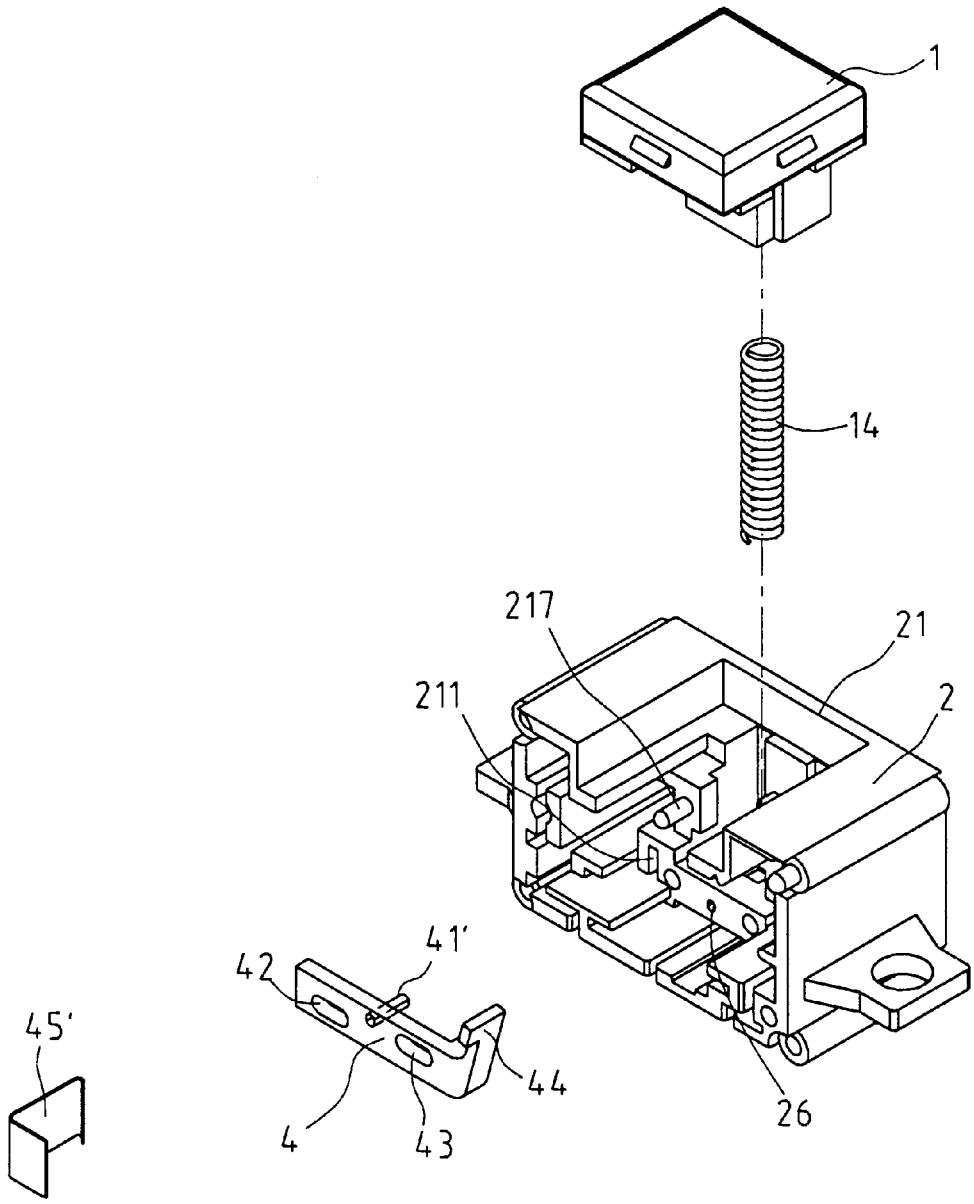
FIG. 8 is an exploded view to show the guide member extends directly from the movable member.

FIG. 8 shows that the guide member 41' may extend from the movable member 4 directly and the movable member 4 is still pushed by an L-shaped spring 45'.

While we have shown and described various embodiments in accordance with the present invention, it should be clear to those skilled in the art that further embodiments may be made without departing from the scope and spirit of the present invention.

What is claimed is:

1. A push-button switch comprising:

a box having a button movably inserted in an open top of said box, a tubular member extending from an underside of said button and a spring biased between said tubular member and said box, a recessed area defined in a surface of said tubular member and defined by a polygonal inner periphery, and two rods respectively extending from an inner side of said box, and a movable member having two slots defined therethrough and said two rods movably received in said two slots, and a guide member extending from said movable member and movably engaged with said recessed area.

2. The switch as claimed in claim 1, further comprising a board extending from an inner side of said box, a recess defined in an underside of said board and an L-shaped spring having one end engaged with said recess, and the other end of said L-shaped spring pushing said movable member toward said recessed area of said button.

3. The switch as claimed in claim 1, wherein said tubular member has a hole defined in an underside thereof so as to receive one end of said spring therein.

4. The switch as claimed in claim 1, further comprising a central member located in a center of said recessed area, a dent defined in a top of said central member, and a triangle plate extending from said inner periphery of said recessed area and located above said dent of said central member, said guide member received in said dent when said guide member is located between said central member and said triangle plate.

5. The switch as claimed in claim 1, further comprising a board extending from an inner side of said box and a hole defined in a surface of said board, said guide member being a U-shaped member, one leg of said U-shaped guide member extending through said movable member, and the other leg of said U-shaped member pivotably received in said hole in said board.

6. The switch as claimed in claim 1, further comprising a push end extending from an end of said movable member.

* * * * *